US008887506B2

(12) United States Patent
Cai et al.

(10) Patent No.: US 8,887,506 B2
(45) Date of Patent: Nov. 18, 2014

(54) FUEL INJECTOR WITH MIXING CIRCUIT

(75) Inventors: Jun Cai, Greenville, SC (US); Mark Allan Hadley, Greer, SC (US); Jayaprakash Natarajan, Greer, SC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 287 days.

(21) Appl. No.: 13/469,217

(22) Filed: May 11, 2012

(65) Prior Publication Data

US 2013/0298562 A1 Nov. 14, 2013

(51) Int. Cl.
*F02C 1/00* (2006.01)

(52) U.S. Cl.
USPC ..... 60/733; 60/737

(58) Field of Classification Search
USPC ..... 60/733, 737, 739, 740, 742
See application file for complete search history.

(56) References Cited

U.S. PATENT DOCUMENTS

| | | | | |
|---|---|---|---|---|
| 3,917,173 | A * | 11/1975 | Singh | 239/400 |
| 5,351,477 | A * | 10/1994 | Joshi et al. | 60/39.463 |
| 8,429,915 | B1 * | 4/2013 | Hadley et al. | 60/748 |
| 2009/0113893 | A1 * | 5/2009 | Li et al. | 60/737 |
| 2010/0018209 | A1 * | 1/2010 | Ramier et al. | 60/740 |
| 2010/0170216 | A1 | 7/2010 | Venkataraman et al. | |
| 2010/0170219 | A1 | 7/2010 | Venkataraman et al. | |
| 2010/0170251 | A1 | 7/2010 | Davis, Jr. et al. | |
| 2010/0170252 | A1 | 7/2010 | Venkataraman et al. | |
| 2010/0170254 | A1 | 7/2010 | Venkataraman et al. | |
| 2010/0174466 | A1 | 7/2010 | Davis, Jr. et al. | |
| 2011/0179803 | A1 * | 7/2011 | Berry et al. | 60/785 |
| 2011/0277481 | A1 | 11/2011 | Bhagat | |

FOREIGN PATENT DOCUMENTS

| | | |
|---|---|---|
| CN | 101776014 | 7/2010 |
| CN | 101776016 | 7/2010 |
| CN | 101776017 | 7/2010 |
| CN | 101776018 | 7/2010 |
| CN | 101782019 | 7/2010 |
| CN | 101782020 A | 7/2010 |
| CN | 101839177 | 9/2010 |
| EP | 2206961 | 7/2010 |
| EP | 2206962 | 7/2010 |
| EP | 2206963 | 7/2010 |
| EP | 2206964 | 7/2010 |
| EP | 2206965 | 7/2010 |
| EP | 2206966 | 7/2010 |
| EP | 2206967 | 7/2010 |
| EP | 2388525 | 11/2011 |
| JP | 2010159758 | 7/2010 |
| JP | 2010159954 | 7/2010 |

(Continued)

*Primary Examiner* — Phutthiwat Wongwian
(74) *Attorney, Agent, or Firm* — Cantor Colburn LLP

(57) ABSTRACT

A fuel injector having an injector body, a mixing circuit, and at least one injector is provided. The injector body has a plurality of manifolds, an inlet, and an outlet. The manifolds are configured for receiving fuel, and the inlet is configured for receiving air. The mixing circuit is positioned within the injector body. The mixing circuit is configured for receiving fuel from at least one of the manifolds, and air from the inlet to create an air-fuel mixture that exits the outlet. The least one fuel injector is positioned radially outwardly from the mixing circuit. The at least one injector receives fuel from at least one of the plurality of manifolds and injects fuel to the outlet.

19 Claims, 2 Drawing Sheets

(56) References Cited

FOREIGN PATENT DOCUMENTS

| | | |
|---|---|---|
| JP | 2010159955 | 7/2010 |
| JP | 2010159956 | 7/2010 |
| JP | 2010159958 | 7/2010 |
| JP | 2010159959 | 7/2010 |
| JP | 2010159961 | 7/2010 |

* cited by examiner

FUEL INJECTOR WITH MIXING CIRCUIT

BACKGROUND OF THE INVENTION

The subject matter disclosed herein relates to a fuel injector, and particularly to a fuel injector having a mixing circuit positioned within an injector body to create an air-fuel mixture.

Gas turbines usually burn hydrocarbon fuels and produce air polluting emissions such as oxides of nitrogen (NOx) and carbon monoxide. Oxidization of molecular nitrogen in the gas turbine depends upon the temperature of gas located in a combustor, as well as the residence time for reactants located in the highest temperatures regions within the combustor. Thus, the amount of NOx produced by the gas turbine may be reduced by either maintaining the combustor temperature below a temperature at which NOx is produced, or by limiting the residence time of the reactant in the combustor.

One approach for controlling the temperature of the combustor involves premixing fuel and air to create a lean air-fuel mixture prior to combustion. This approach includes the development of fuel injection where the air-fuel mixture is injected into and mixed with a main flow of high energy fluid from the combustor. Specifically, the air-fuel mixture becomes entrained with the main flow of high energy fluid before ignition. This approach results in increasing the consumption of fuel, which in turn reduces the air polluting emissions.

A secondary fuel injector may be provided to inject the air-fuel mixture into the main flow from the combustor. Specifically, for example, the secondary fuel injector may include outer fuel injection as well as inner fuel injection. However, the inner fuel injection may produce relatively high NOx emissions, as a diffusion flame created by the inner fuel injector generally has an elevated flame temperature.

BRIEF DESCRIPTION OF THE INVENTION

According to one aspect of the invention, a fuel injector having an injector body, a mixing circuit, and at least one injector is provided. The injector body has a plurality of manifolds, an inlet, and an outlet. The manifolds are configured for receiving fuel, and the inlet is configured for receiving air. The mixing circuit is positioned within the injector body. The mixing circuit is configured for receiving fuel from at least one of the manifolds, and air from the inlet to create an air-fuel mixture that exits the outlet. The least one fuel injector is positioned radially outwardly from the mixing circuit. The at least one injector receives fuel from at least one of the plurality of manifolds and injects fuel to the outlet.

According to another aspect of the invention, a combustor for a gas turbine having at least one primary fuel injector and at least one secondary fuel inject that is disposed downstream of the primary fuel injector is provided. The secondary fuel injector has an injector body, a mixing circuit, and at least one injector. The injector body has a plurality of manifolds, an inlet, and an outlet. The manifolds are configured for receiving fuel, and the inlet is configured for receiving air. The mixing circuit is positioned within the injector body. The mixing circuit is configured for receiving fuel from at least one of the manifolds, and air from the inlet to create an air-fuel mixture that exits the outlet. The least one fuel injector is positioned radially outwardly from the mixing circuit. The at least one injector receives fuel from at least one of the plurality of manifolds and injects fuel to the outlet.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
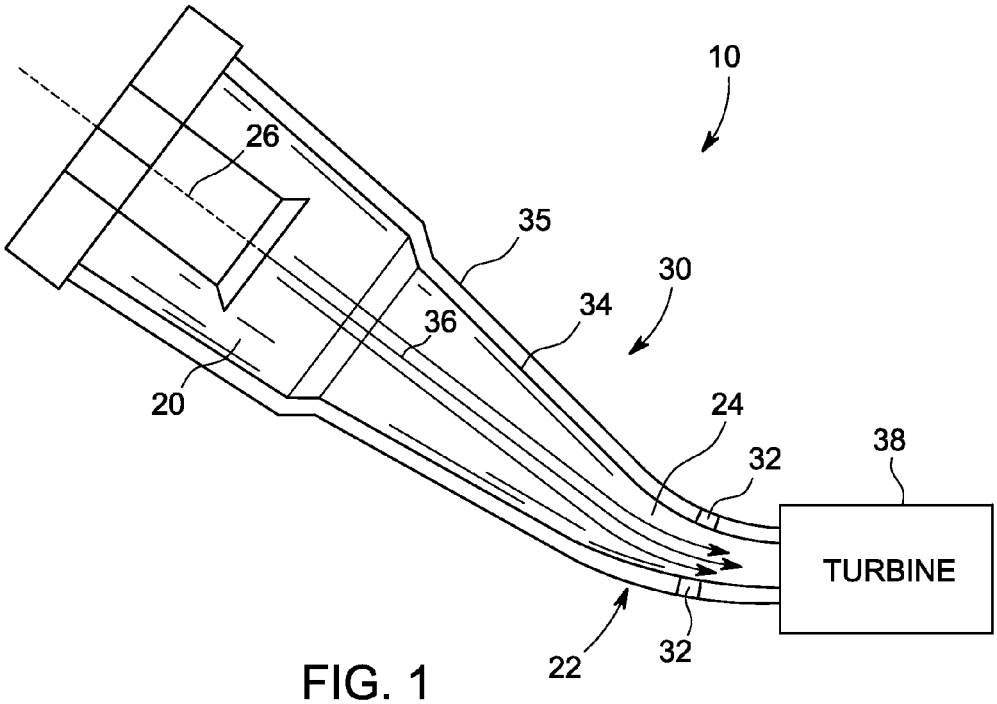
FIG. 1 is an exemplary schematic illustration of a combustor for a gas turbine.

FIG. 1 is an exemplary schematic illustration of a combustor 10 for a gas turbine engine (not shown). The combustor 10 includes a primary combustion section 20, a transition piece 22, and a secondary combustion section 24. The primary combustion section 20 includes at least one primary fuel injector 26. Disposed downstream of the primary combustion section 20 is the transition piece 22 and the secondary combustion section 24. In one embodiment, a secondary injection system 30 is disposed outside of the transition piece 22 and includes a plurality of secondary fuel injectors 32, however it is to be understood that the secondary injection system 30 could be located outside of a combustion liner 34 as well. For example, in the embodiment as shown in FIG. 1, the secondary fuel injectors 32 are placed between the combustion liner 34 and a flow sleeve 35. A primary combustion stream or main flow 36 is created by the combustion of air and fuel from primary fuel injector 26, which travels through the primary combustion section 20 to the secondary injection system 30. The air-fuel mixture (not shown in FIG. 1) injected by the secondary fuel injectors 32 penetrates the oncoming main flow 36. The fuel supplied to the secondary fuel injectors 32 are combusted in the secondary combustion section 24 before entering a turbine section 38 of a gas turbine (not shown).

Figure 2:
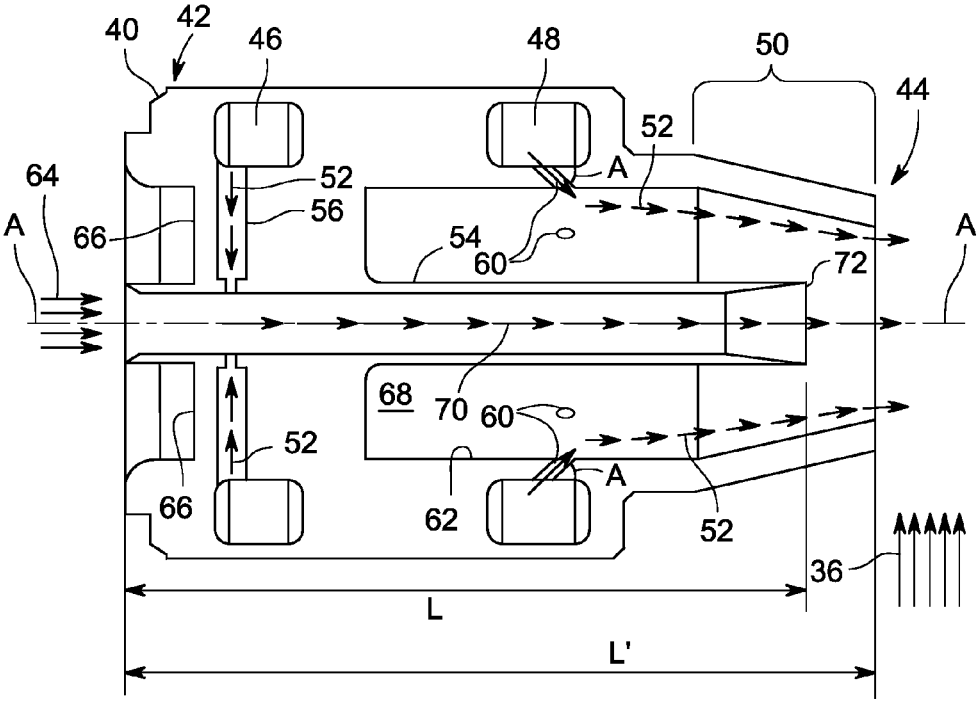
FIG. 2 is a cross-sectioned view of a fuel injector for the combustor shown in FIG. 1.

Turning now to FIG. 2, one of the secondary fuel injectors 32 of the secondary injection system 30 is shown in cross-section. The secondary fuel injector 32 includes a generally tubular injector body 40. The injector body 40 includes an inlet 42, an outlet 44, at least one center circuit fuel manifold 46, and at least one outer or fuel injector manifold 48. In the exemplary embodiment as shown in FIG. 2, the injector body 40 may include a converging section or nozzle portion 50 that terminates at the outlet 44. The center circuit manifold 46 and the fuel injector manifold 48 both receive fuel 52 through an aperture (not illustrated) defined by the injector body 40. The center circuit fuel manifold 46 is fluidly connected to a mixing circuit 54 through a passageway 56 defined by the injector body 40. The fuel injector manifold 48 is fluidly connected to at least one fuel injector 60 that is defined by the injector body 40. In the embodiment as shown in FIG. 2, multiple fuel injectors 60 are provided, and are located along an inner wall 62 of the injector body 40. The inlet 42 may receive air 64 from a compressor (not illustrated), where the air 64 is received only by the mixing circuit 54. That is, a wall 66 may be provided to generally block the air 64 from flowing into a main inner cavity 68 of the secondary fuel injector 32.

The air 64 mixes with the fuel 52 to create an air-fuel mixture 70 that exits or discharges from an opening 72 of the mixing circuit 54. The opening 72 is located within the main cavity 68. The air-fuel mixture 70 flows out of the opening 72 and exits the secondary fuel injector 32 through the outlet 44. In the embodiment as shown in FIG. 2, the air-fuel mixture 70 is oriented in a direction that is generally perpendicular to the main flow 36 created by the combustion of air and fuel from the primary fuel injector 26 (that is shown in FIG. 1).

In the embodiment as shown, the mixing circuit 54 has a generally cylindrical configuration, and includes a length L that extends along a centrally located axis A-A of the injector body 40. In one embodiment, the mixing circuit 54 may extend from the inlet 42 to the fuel injectors 60. In the embodiment as shown in FIG. 2, the mixing circuit 54 extends from the inlet 42 and into the nozzle portion 50 of the injector 40. However, the length L of the mixing circuit 54 is less than an overall length L' of the injector body 40. That is, in other words, the opening 72 of the mixing circuit 54 is positioned within the main inner cavity 68, and does not extend past the outlet 44 of the injector body 40.

Continuing to refer to FIG. 2, the fuel 52 from the fuel injector manifold 48 is supplied to the fuel injectors 60. The fuel injectors 60 are positioned radially outwardly from the mixing circuit 54. The fuel injectors 60 direct the fuel 52 out of the outlet 44 of the injector 40 and into the main flow 36. In the embodiment as shown, the fuel injectors 60 are defined by the injector body 40, and are oriented at an angle A with respect to the central axis A-A of the injector body 40. Specifically, in the exemplary embodiment as shown, the fuel injectors 60 are angled at about 45°, however it is understood that the fuel injectors 60 may be angled between about 30° to about 90° with respect to the central axis A-A. The fuel injectors 60 may be angled to substantially prevent the occurrence of flame holding, which occurs at a location downstream of the fuel injectors 60. Additionally, the fuel injectors 60 may be angled to adjust the amount of penetration of the fuel 52 into the main flow 36.

Figure 3:
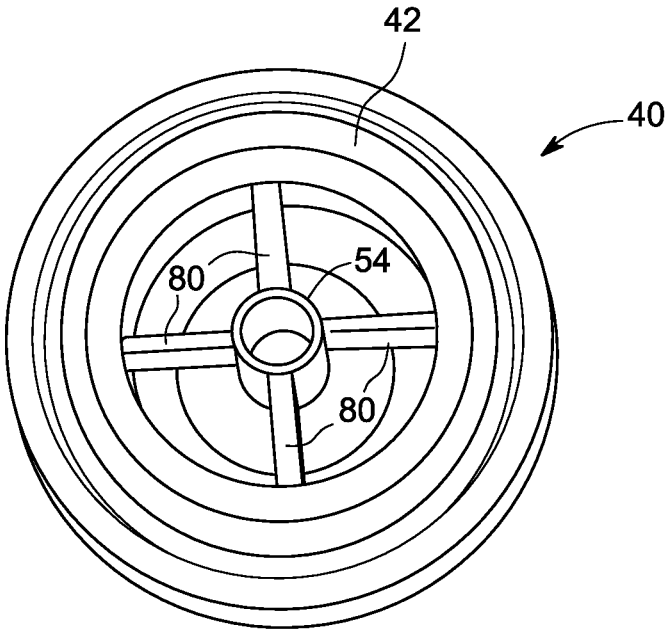
FIG. 3 is a view of an inlet of the fuel injector shown in FIG. 2.
Figure 4:
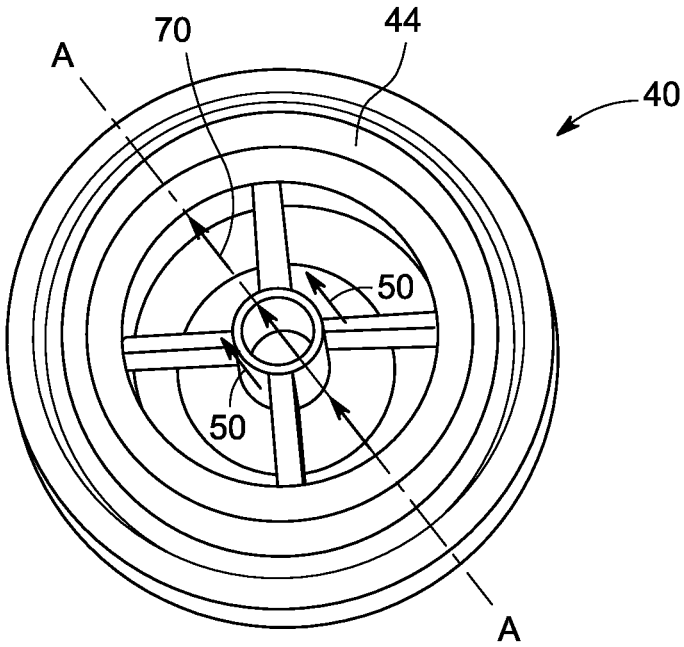
FIG. 4 is a view of an outlet of the fuel injector shown in FIG. 2.

FIG. 3 is an illustration of the inlet 42 of the injector 40, where a plurality of struts or support members 80 may be used to position the mixing circuit 54 along the central axis A-A of the injector body 40. Specifically, in the embodiment as shown in FIG. 3, four supporting members 80 are positioned generally equidistant from one another. FIG. 4 is an illustration of the outlet 44 of the injector 40. As seen in FIG. 4, the fuel 52 and the air-fuel mixture 70 both exit the injector 40 at the outlet 44 in separate streams. The air-fuel mixture 70 flows along the central axis A-A of the injector body 40, and flow of fuel 52 is located radially outwardly from the air-fuel mixture 70.

Referring now to FIGS. 2-4, the length L of the mixing circuit 54 is sized to allow the air-fuel mixture 70 to exit the injector 40 without prematurely mixing with the fuel 52. That is, the air-fuel mixture 70 does not generally mix with the fuel 52 within the main inner cavity 68. Mixing of the air-fuel mixture 70 with the fuel 52 within the main inner cavity 68 may cause the air-fuel mixture 70 to ignite prematurely, which in turn may produce relatively high NOx emissions. Moreover, the air-fuel mixture 70 also creates a relatively cooler inner circuit flame (not illustrated), especially when compared to an inner circuit flame created by some types of secondary injectors currently available that only inject fuel, and not air, through a center circuit. Thus, the mixing circuit 54 will result in decreased inner circuit flame temperatures, which in turn reduces NOx emissions.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injector, comprising:

a secondary injector body located downstream of a primary fuel injector, the secondary injector body having a plurality of manifolds, an inlet, and an outlet, the plurality of manifolds configured for receiving fuel and the inlet configured for receiving air;

a mixing circuit positioned within the injector body, the mixing circuit configured for receiving fuel from a first manifold of the plurality of manifolds and air from the inlet to create an air-fuel mixture that exits the outlet; and at least one injector positioned radially outwardly from the mixing circuit, the at least one injector receiving fuel from a second manifold of the plurality of manifolds and injecting fuel to the outlet, wherein the air-fuel mixture and the fuel routed to and through the at least one injector are fluidly isolated from each other along an entire length of the mixing circuit prior to injection into a secondary combustion section of a gas turbine engine.

2. The fuel injector of claim 1, wherein the injector body includes a central axis, wherein the mixing circuit extends along the central axis.

3. The fuel injector of claim 1, wherein a length of the mixing circuit extends from the inlet to the at least one injector.

4. The fuel injector of claim 1, wherein the injector body includes a converging section that terminates at the outlet.

5. The fuel injector of claim 4, wherein a length of the mixing circuit extends into the converging section of the injector body.

6. The fuel injector of claim 1, wherein the injector body includes an injector body length, and wherein a length of the mixing circuit is less than the injector body length.

7. The fuel injector of claim 1, wherein the at least one injector is angled between about 30° to about 90° with respect to a central axis of the injector body.

8. The fuel injector of claim 1, wherein the fuel injector includes at least one center circuit fuel manifold fluidly connected to the mixing circuit through a passageway defined by the injector body.

9. The fuel injector of claim 1, wherein the fuel injector includes at least one injector manifold fluidly connected to the at least one injector.

10. A combustor for a gas turbine, comprising:

at least one primary fuel injector;

at least one secondary fuel injector that is disposed downstream of the at least one primary fuel injector, the at least one secondary fuel injector comprising:

an injector body having a plurality of manifolds, an inlet, and an outlet, the plurality of manifolds configured for receiving fuel and the inlet configured for receiving air;

a mixing circuit positioned within the injector body, the mixing circuit configured for receiving fuel from a first manifold of the plurality of manifolds and air from the inlet to create an air-fuel mixture that exits the outlet; and at least one injector positioned radially outwardly from the mixing circuit, the at least one injector receiving fuel from a second manifold of the plurality of manifolds and injecting fuel to the outlet, wherein the air-fuel mixture and the fuel routed to and through the at least one injector are fluidly isolated from each other along an entire length of the mixing circuit prior to injection into a secondary combustion section of a gas turbine engine.

11. The combustor of claim 10, wherein the injector body includes a central axis, wherein the mixing circuit extends along the central axis.

12. The combustor of claim 10, wherein a length of the mixing circuit extends from the inlet to the at least one injector.

13. The combustor of claim 10, wherein the injector body includes a converging section that terminates at the outlet.

14. The combustor of claim 13, wherein a length of the mixing circuit extends into the converging section of the injector body.

15. The combustor of claim 10, wherein the injector body includes an injector body length, and wherein a length of the mixing circuit is less than the injector body length.

16. The combustor of claim 10, wherein the at least one injector is angled between about 30° to about 90° with respect to a central axis of the injector body.

17. The combustor of claim 10, wherein the at least one secondary fuel injector includes at least one center circuit fuel manifold fluidly connected to the mixing circuit through a passageway defined by the injector body.

18. The combustor of claim 10, wherein the at least one secondary fuel injector includes at least one injector manifold fluidly connected to the at least one injector.

19. A combustor for a gas turbine, comprising:

at least one primary fuel injector;

at least one secondary fuel injector that is disposed downstream of the at least one primary fuel injector, the at least one secondary fuel injector comprising:

an injector body having a central axis, a plurality of manifolds, an inlet, and an outlet, the plurality of manifolds configured for receiving fuel and the inlet configured for receiving air;

a mixing circuit positioned within the injector body and extending along the central axis, the mixing circuit configured to receive fuel from a first manifold of the plurality of manifolds and air from the inlet to create an air-fuel mixture that exits the outlet; and at least one injector positioned radially outwardly from the mixing circuit, the at least one injector receiving fuel from a second manifold of the plurality of manifolds and injecting fuel to the outlet, the at least one injector being angled with respect to the central axis, wherein the air-fuel mixture and the fuel routed to and through the at least one injector are fluidly isolated from each other along an entire length of the mixing circuit prior to injection into a secondary combustion section of a gas turbine engine.

* * * * *